United States Patent [19]

Rotondo et al.

[11] 4,441,311

[45] Apr. 10, 1984

[54] MEANS FOR CONTROLLING THE AIR SCAVENGE PRESSURE IN THE BEARING COMPARTMENT OF A GAS TURBINE ENGINE

[75] Inventors: Claude P. Rotondo, Middletown; John D. Robinson, Jr., Tolland, both of Conn.

[73] Assignee: United Technologies Corporation, Hartford, Conn.

[21] Appl. No.: 377,758

[22] Filed: May 13, 1982

[51] Int. Cl.[3] ..... F02C 7/06

[52] U.S. Cl. ..... 60/39.08; 184/6.11

[58] Field of Search ..... 60/39.07, 39.08, 39.1; 181/6.11; 415/110, 111, 112, 175, 176

[56] References Cited

U.S. PATENT DOCUMENTS

| | | | |
|---|---|---|---|
| 3,171,354 | 3/1965 | Söhlemann | 415/175 X |
| 3,378,104 | 4/1968 | Venable | 60/39.08 |
| 3,884,041 | 5/1975 | Zerlauth | 60/39.08 X |

*Primary Examiner*—Louis J. Casaregola
*Assistant Examiner*—Donald E. Stout
*Attorney, Agent, or Firm*—Charles A. Warren

[57] ABSTRACT

A gas turbine engine has a bearing compartment with seals for confining the oil in a compartment and with compressor discharge pressure supplied to the seals externally of the compartment and in which a restrictive valve controlling the compartment vent is actuated by compressor discharge pressure to be opened in response to a drop in this pressure.

4 Claims, 1 Drawing Figure

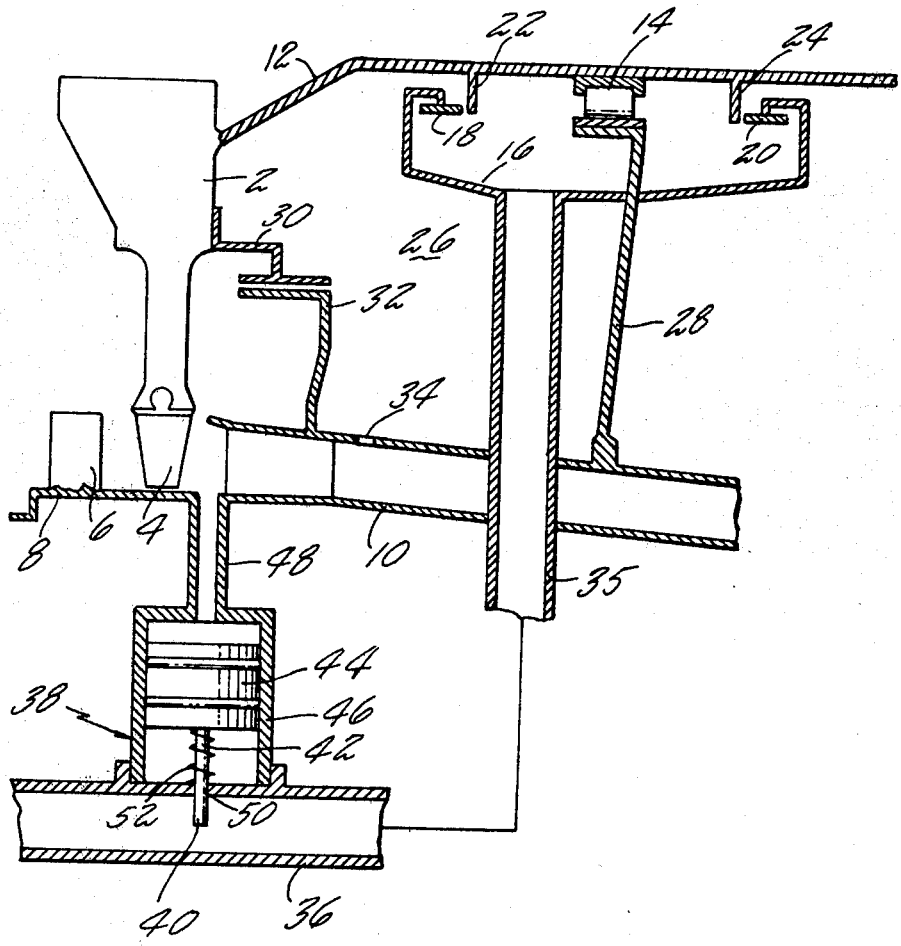
12
22
14
24
18
16
20
2
30
26
32
28
34
8
6
4
48
10
35
44
38
46
42
52
50
40
36

MEANS FOR CONTROLLING THE AIR SCAVENGE PRESSURE IN THE BEARING COMPARTMENT OF A GAS TURBINE ENGINE

DESCRIPTION

1. Technical Field

The pressure in the bearing compartment in a gas turbine engine is controlled so as to maintain a suitable pressure drop across the seals in the event of a sudden loss in sealing air pressure.

2. Background Art

The bearing compartment seal pressure drops are maintained at the desired level by allowing the scavenge oil and breather air to exit in a common line which has the necessary restriction to produce the desired level of compartment pressure. There is a problem if there is a sudden loss of compartment sealing air source pressure, such loss of pressure resulting, for example, from a surge in the compressor or from a quick deceleration of the engine. The resulting loss of compartment sealing air could cause a reversal of pressure drop across the seal with the possibility of oil loss and/or of fire in the engine.

The copending application of Norris and Picard Ser. No. 377,746 filed May 13, 1982 having the same assignee as this application describes the use of a restrictor valve on the breather/scavenge pipe. In that application the valve is actuated in response to a drop in the oil pressure supplied to the bearing, this oil pressure being a function of the engine speed. The actuation of the restrictor valve in response to oil pressure is not immediately responsive to a sudden change in the engine operation as an interval before the change in engine speed occurs.

DISCLOSURE OF INVENTION

The present invention involves a concept in which the actuation of the restrictor valve is responsive to compressor discharge pressure thereby directly relating the actuation valve to a drop in the pressure of the sealing air supplied to the seals at the bearing compartment.

A feature of the invention is the removal of the restriction in the breather/scavenge line in the event of a sudden drop in pressure in the air supply line thereby to produce a rapid drop in pressure in the bearing compartment.

Another feature of the invention is to make the removal of the restriction responsive to the compressor discharge pressure which is the source of the sealing air for the bearing seals.

According to the invention the breather/scavenge line through which the air/oil mixture from the bearing compartment is vented has a movable restriction that is normally in restricting position thereby maintaining a relatively high pressure in the bearing compartment. If there is a sudden drop in the compressor discharge pressure that could create a pressure reversal at the seals, the restriction is removed in response to this drop in pressure. More particularly this is accomplished by a valve in the breather/scavenge line that is held partially closed by compressor discharge pressure acting through a pressure cylinder with the valve urged into open position by a spring when there is a drop in compressor discharge pressure.

The foregoing and other objects, features and advantages of the present invention will become more apparent in the light of the following detailed description of the preferred embodiments thereof as shown in the accompanying drawing.

BRIEF DESCRIPTION OF THE DRAWING

The single FIGURE is a diagrammatic view of a part of the engine showing the bearing compartment and seals with a restrictor valve and its actuation shown in detail.

BEST MODE FOR CARRYING OUT THE INVENTION

The invention is shown as applied to a gas turbine engine having a compressor rotor 2 with the blades 4 on its periphery cooperating with a row of vanes 6 in a casing 8. The drawing shows the compressor discharge end of the compressor with the air discharging into a duct 10 leading to the combustion chambers. The rotor is carried by a shaft 12 supported by the bearing 14 in the compartment 16. Seals 18 and 20 carried at opposite ends of the compartment cooperate with flanges 22 and 24 on the shaft to seal the compartment and prevent oil leakage. Air under pressure is supplied from the compressor discharge to a chamber 26 surrounding the shaft. This chamber also encloses the bearing support structure 28 and surrounds the bearing compartment 16. The upper end of this chamber is defined by cooperating seal elements 30 and 32 carried by the rotor and stationary structure respectively. The sealing air that enters this chamber may be that air leaking past the seal elements 30 and 32 into the chamber. In this way the sealing pressure on the outer sides of the seals 18 and 20 external to the compartment 16, is subject to the same pressure as the compressor discharge pressure as modified by a drop across the seals. Alternatively the sealing air may be supplied through an opening 34 in the duct wall.

Compartment 16 has a breather/scavenge pipe 35 leading to a discharge line 36. In this line the valve 38 is in the form of a sliding plate 40 carried on a rod 42 secured to a piston 44 in a cylinder 46. The end of the cylinder 46 is connected to the compressor discharge duct by a small diameter duct 48 so that compressor discharge pressure in the cylinder normally holds the plate 40 in the restrictive position shown.

This plate which slides in a slot 50 in the pipe is urged into nonrestricting (upper) position by a spring 52. Thus when compressor discharge pressure drops suddenly, for example, in a compressor surge or at a deceleration of the engine the restrictive plate is raised immediately by the spring force overriding the reduced force applied on the piston by the compressor discharge pressure. When compressor discharge pressure again reaches normal the restrictive plate is urged by this pressure back into the restrictive position shown.

In this way, when there is a drop in pressure of sealing air in the chamber 26 the restriction is open and the pressure in the compartment 16 is dropped before there can be a pressure reversal across the seals that could cause oil leakage or even a fire. When the compressor discharge pressure is restored the restriction will be repositioned and the desired pressure drop across the seal will be reestablished.

Although the invention has been shown and described with respect to a preferred embodiment thereof, it should be understood by those skilled in the art that other various changes and omissions in the form and detail thereof may be made therein without departing from the spirit and the scope of the invention.

We claim:

1. In a gas turbine engine having a rotor and a compressor discharge passage:

a bearing for the rotor;

a compartment surrounding the bearing;

seals cooperating with the compartment to prevent leakage or oil from said compartment;

means for supplying compressor discharge air from said passage to said seals externally of the compartment;

a vent duct for the compartment;

a restrictive valve in said duct for controlling the air flow and;

pressure actuated means responsive to compressor discharge pressure to actuate said valve.

2. A gas turbine engine as in claim 1 including a cylinder and piston, the cylinder being connected with the compressor discharge passage and the piston being connected to said valve.

3. A gas turbine engine as in claim 1 in which said valve is in the form of a restrictive plate in said duct and spring means are provided for urging the plate into nonrestrictive position.

4. A gas turbine engine as in claim 2 in which the valve is in the form of a plate in said duct carried by said piston and having spring means urging the plate into nonrestrictive position in the vent duct.

* * * * *